US009227754B2

(12) United States Patent
Liu et al.

(10) Patent No.: US 9,227,754 B2
(45) Date of Patent: Jan. 5, 2016

(54) FOLDING BOX

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Hai Liu, Shenzhen (CN); Ming-Chang Lee, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/469,817

(22) Filed: Aug. 27, 2014

(65) Prior Publication Data

US 2015/0060443 A1 Mar. 5, 2015

(30) Foreign Application Priority Data

Aug. 29, 2013 (CN) ..... 2013 1 0383642

(51) Int. Cl.
*B65D 6/00* (2006.01)
*B65D 6/18* (2006.01)

(52) U.S. Cl.
CPC ..... *B65D 11/1833* (2013.01)

(58) Field of Classification Search
CPC ..... B65D 7/30; B65D 7/32; B65D 9/24; B65D 9/22; B65D 11/1833; B65D 11/18; B65D 88/52; B65D 2501/24184; B65D 2501/24146; B65D 2501/2405
USPC ..... 220/7, 6, 4.28, 4.29, 666, 676, 617, 220/677, 684, 682, 691; 206/600
See application file for complete search history.

(56) References Cited

U.S. PATENT DOCUMENTS

| | | | | |
|---|---|---|---|---|
| 8,413,831 | B2 * | 4/2013 | Nolan | 220/7 |
| 2007/0017916 | A1 * | 1/2007 | Sabanci | 220/7 |
| 2013/0299490 | A1 * | 11/2013 | Hansen et al. | 220/7 |

* cited by examiner

*Primary Examiner* — Robert J Hicks
*Assistant Examiner* — Kareen Thomas
(74) *Attorney, Agent, or Firm* — Novak Druce Connolly Bove + Quigg LLP

(57) ABSTRACT

A folding box includes a rectangular base, two side boards, two end boards, and two mounting apparatuses mounted to each side board. The base includes a bottom plate, two side plates protruding up from two opposite sides of the bottom plate, and two end plates protruding up from two opposite ends of the bottom plate. The side boards are rotatably connected to the two side plates. The end boards are rotatably connected to the two end plates. Each mounting apparatus includes a first inserting member slidably installable on the corresponding side board. A flange protrudes inward from each end of each end board. A protrusion protrudes inward from each flange. Each protrusion defines a latching hole aligning with the corresponding first inserting member. Each first inserting member is inserted into the corresponding latching hole, to connect the side boards to the end boards.

8 Claims, 6 Drawing Sheets

FOLDING BOX

FIELD

The present disclosure relates to a folding box.

BACKGROUND

Boxes are often used to store goods. However, boxes with a fixed configuration occupy too much space when not in use.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean "at least one."

Figure 1:
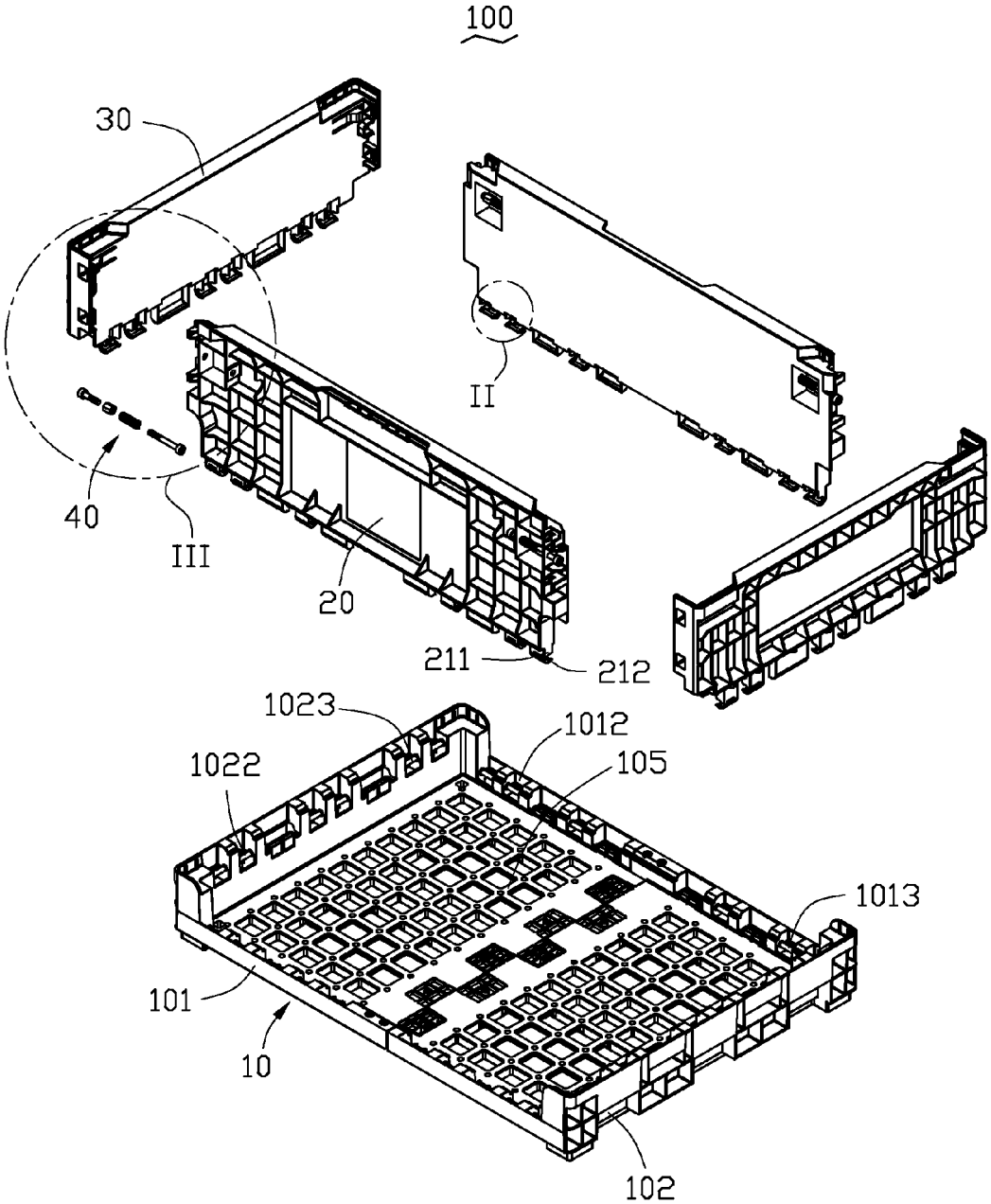
FIG. 1 is an exploded perspective view of an embodiment of a folding box.

FIG. 1 shows an embodiment of a folding box 100 comprising a base 10, two opposite side boards 20, two opposite end boards 30, and a plurality of mounting apparatuses 40.

The base 10 comprises a substantially rectangular bottom plate 105, two side plates 101 substantially perpendicularly extending up from two opposite sides of the bottom plate 105, and two end plates 102 substantially perpendicularly extending up from two opposite ends of the bottom plate 105. An inner side of each side plate 101 defines a plurality of receiving slots 1012. A corresponding shaft 1013 is mounted and received in each receiving slot 1012. Each shaft 1013 is substantially parallel to a lengthwise direction of the side plates 101. An inner side of each end plate 102 defines a plurality of receiving slots 1022, a shaft 1023 is mounted in each receiving slot 1022, and each shaft 1023 is parallel to a lengthwise direction of the end plates 102.

Figure 2:
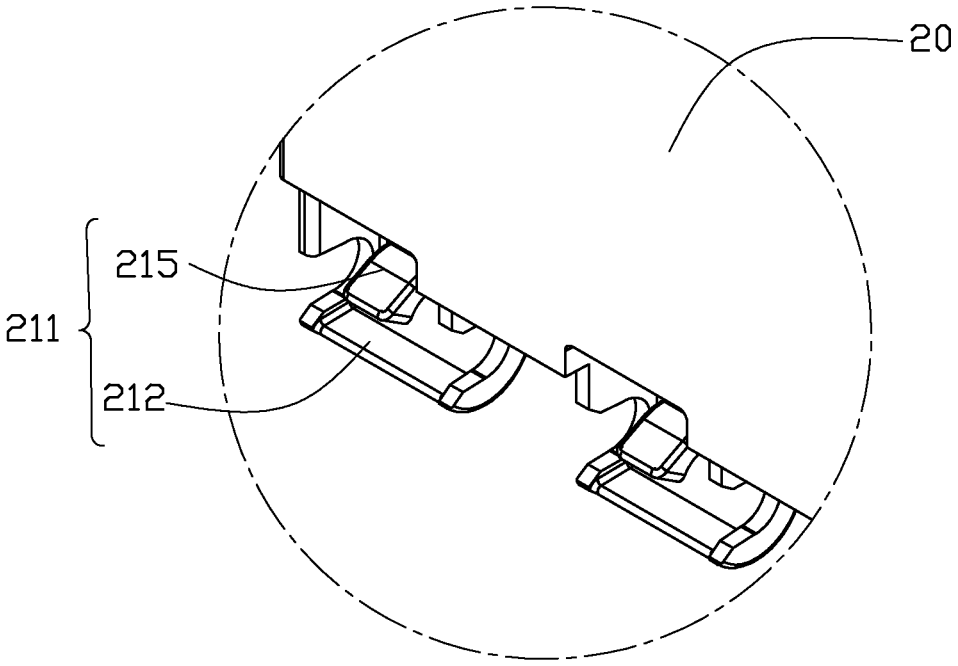
FIG. 2 is an enlarged perspective view of a circled portion II of FIG. 1.
Figure 3:
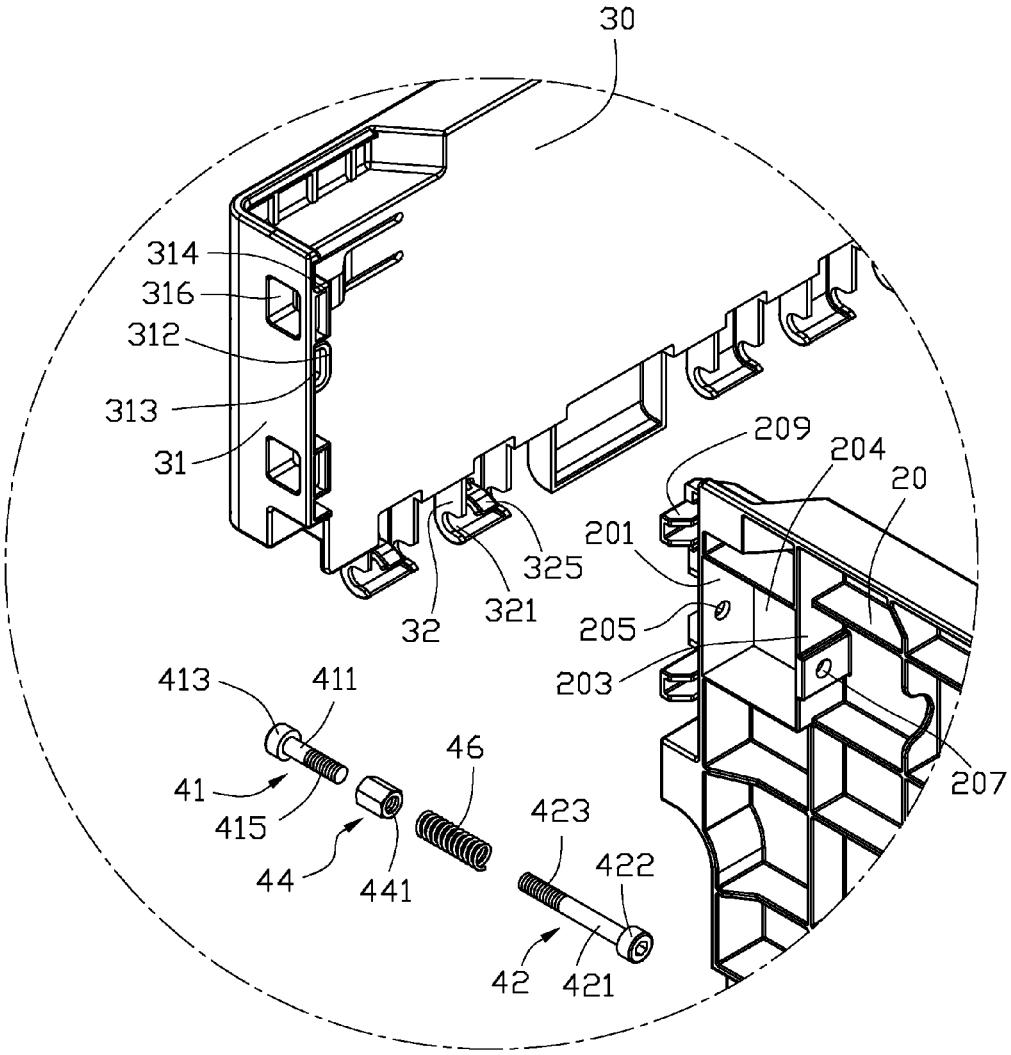
FIG. 3 is an enlarged perspective view of a circled portion III of FIG. 1.

Referring to FIG. 2 and FIG. 3, a first piece 201 and a second piece 203 substantially perpendicularly extend out from each end portion of an outer side of the side board 20. The first piece 201 and the second piece 203 are spaced from each other. The first piece 201 is closer to a corresponding end of the side board 20 than the second piece 203. Each first piece 201 and the corresponding second piece 203 cooperatively bound an installing slot 204. Each first piece 201 defines a though hole 205, and each second piece 203 defines a fastening hole 207 aligned with the corresponding through hole 205. Two spaced latching blocks 209 protrude out from each corresponding end of the side board 20. One latching block 209 is located above the corresponding through hole 205, and the other latching block 209 is located below the corresponding through hole 205. A plurality of resilient hooks 211 protrudes down from a bottom of each side board 20. The hooks 211 are arrayed along a lengthwise direction of the side board 20. Each hook 211 comprises a substantially C-shaped rotating portion 212 located at a bottom of the hook 211, and a resilient arcuate tab 215 located above the rotating portion 212.

A flange 31 substantially perpendicularly extends inward from each end of each end board 30. A protrusion 312 protrudes from an inner surface of each flange 31. Each protrusion 312 defines a latching hole 313. Two spaced positioning blocks 314 protrude from the inner surface of each flange 31. One positioning block 314 is located above the corresponding protrusion 312, and the other positioning block 314 is located below the corresponding protrusion 312. Two positioning holes 316 are defined in each flange 31. Each positioning hole 316 extends through a corresponding positioning block 314. A plurality of resilient hooks 32 protrudes down from a bottom of each end board 30. The hooks 32 are arrayed along a lengthwise direction of the end board 30. Each hook 32 comprises a substantially C-shaped rotating portion 321 located at a bottom of the hook 32, and an arcuate and resilient tab 325 located above the rotating portion 321.

Each mounting apparatus 40 comprises a first inserting member 41, a second inserting member 42, a threaded sleeve 44, and a resilient member 46. The first inserting member 41 comprises a threaded pole 411, an inserting portion 415 located at a first end of the threaded pole 411, and a positioning portion 413 located at a second end of the threaded pole 411 opposite to the inserting portion 415. The second inserting member 42 comprises a threaded pole 421, a stopping portion 422 located at a first end of the threaded pole 421, and an inserting portion 423 located at a second end of the threaded pole 421 opposite to the stopping portion 422. The threaded sleeve 44 defines a threaded through hole 441. In the embodiment, the first inserting member 41 and the second inserting member 42 are screws, the threaded sleeve 44 is a nut, and the resilient member 46 is a spring.

Figure 4:
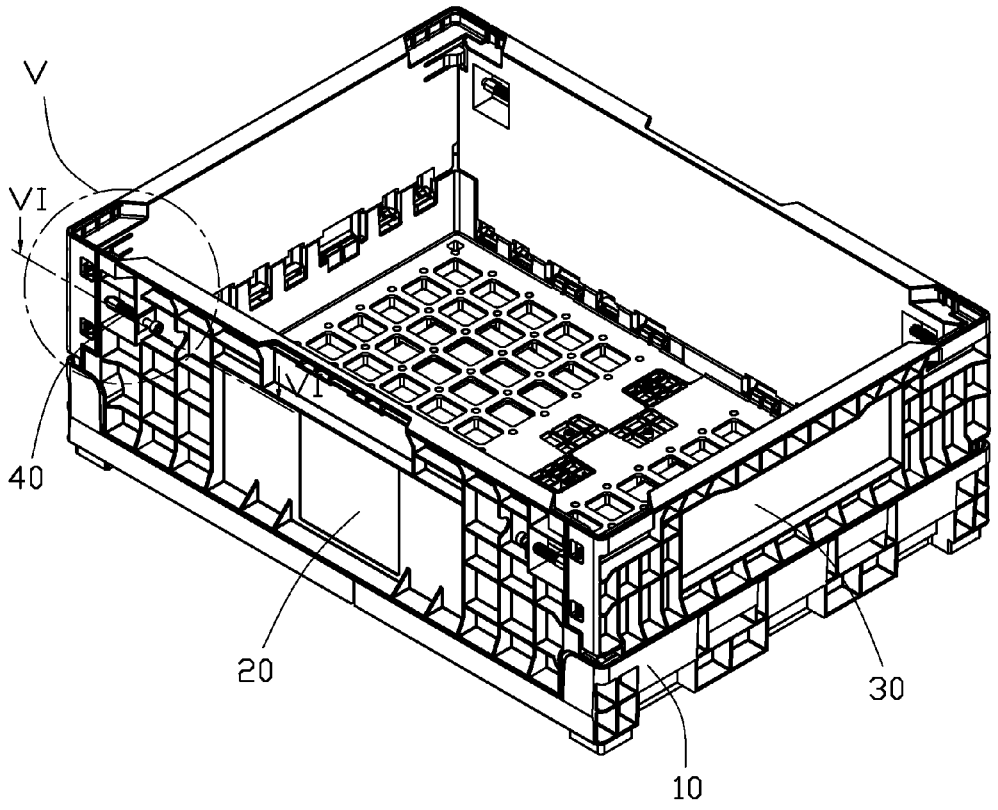
FIG. 4 is an assembled perspective view of the folding box of FIG. 1.
Figure 5:
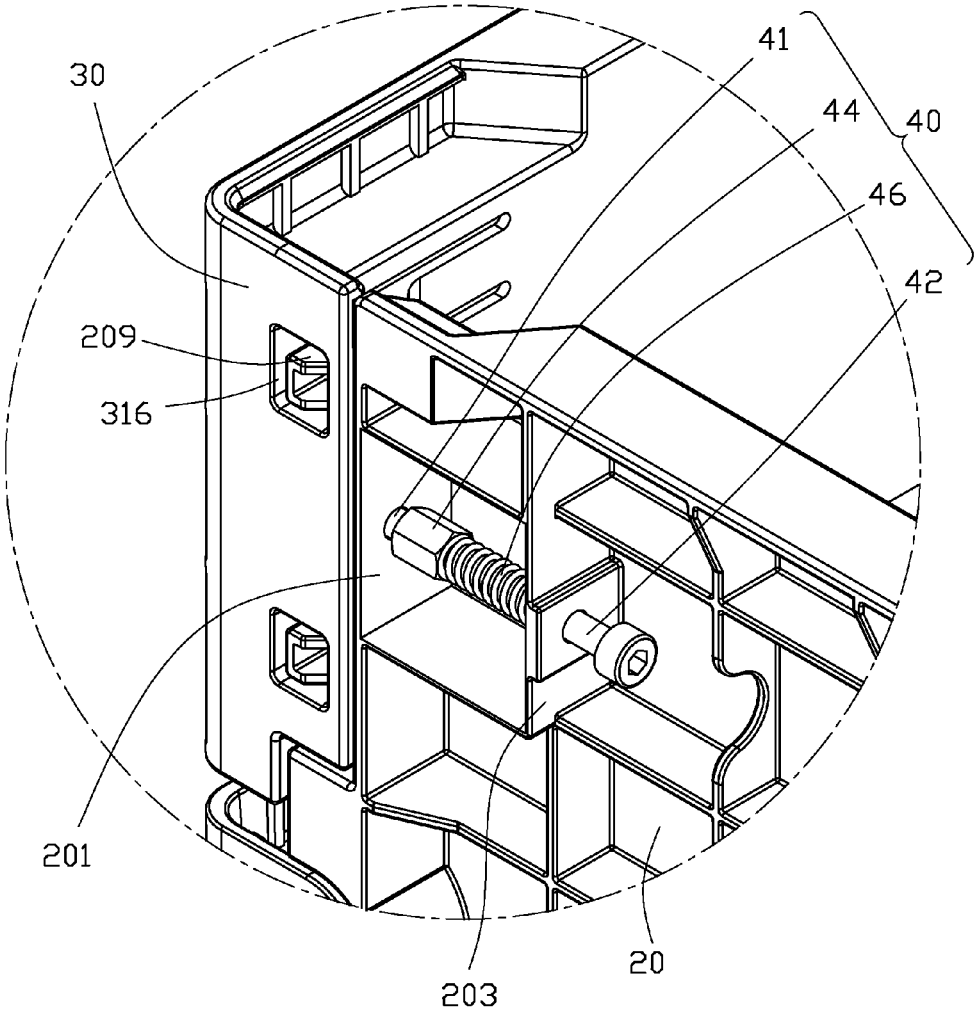
FIG. 5 is an enlarged perspective view of a circled portion V of FIG. 4.
Figure 6:
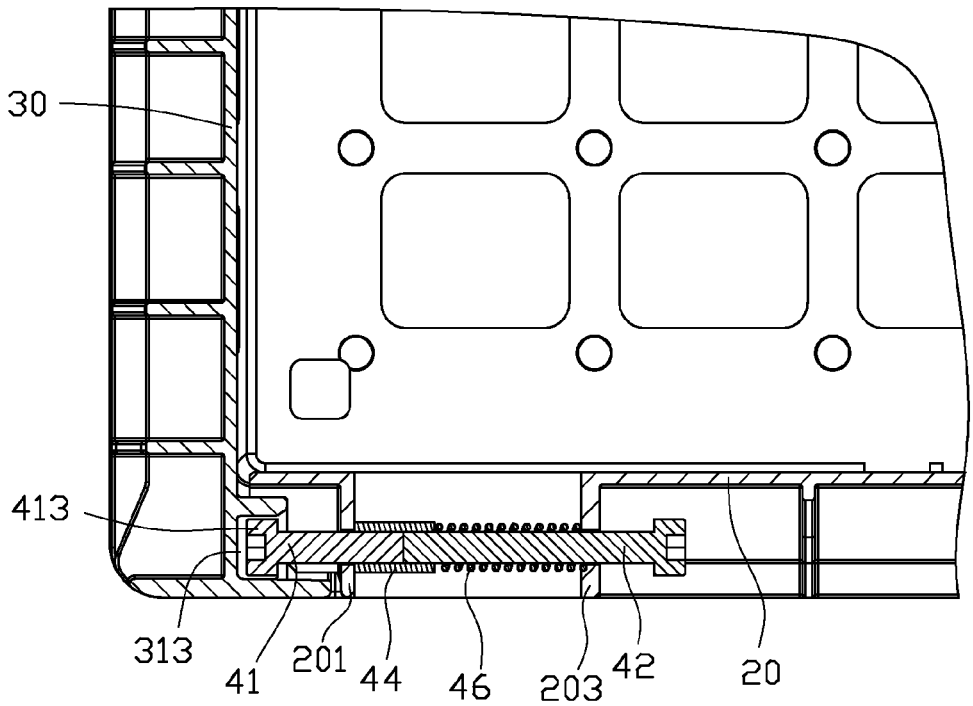
FIG. 6 is a cross-sectional view of FIG. 4, taken along line VI-VI.

FIG. 4, FIG. 5, and FIG. 6 show assembled states of the folding box 100. Each threaded sleeve 44 and the corresponding resilient member 46 are received in the corresponding installing slot 204, and respectively aligned with the corresponding through hole 205 and fastening hole 207. The inserting portion 415 of each first inserting member 41 extends through the through hole 205 from an outer side of the corresponding first piece 201 to engage in the threaded through hole 441 of the corresponding threaded sleeve 44. The inserting portion 423 of each second inserting member 42 extends through the fastening hole 207 of the corresponding second piece 203 and the corresponding resilient member 46 to engage in the threaded through hole 441 of the corresponding threaded sleeve 44. Thus, the mounting apparatuses 40 are installed in the side boards 20. Each resilient member 46 is resiliently pressed between the second piece 203 and the corresponding threaded sleeve 44.

The hooks 211 of each side board 20 are inserted into the receiving slots 1012 of the corresponding side plate 101, such that the rotating portions 212 are rotatable about the shafts 1013. Each tab 215 prevents the corresponding hook 211 from detaching from the corresponding shaft 1013. The hooks 32 of each end board 30 are inserted into the receiving slots 1022 of the corresponding end plate 102, such that the shafts 1023 are rotatable about the rotating portions 321. Each tab 325 prevents the corresponding hook 32 from detaching from the corresponding shaft 1023. Thus, the side boards 20 are rotatable relative to the side plates 101, and the end boards 30 are rotatable relative to the end plates 102.

The end boards 30 are rotated about the corresponding shafts 1023, until the end boards 30 are substantially perpendicular to the base 10. Each second inserting member 42 is pulled away from the corresponding first piece 201, thus elastically deforming the corresponding elastic member 46 and moving the corresponding first inserting member 41 and the corresponding threaded sleeve 44 toward the corresponding second piece 203, until the positioning portion 413 is stopped by the corresponding first piece 201. The side boards 20 are rotated about the corresponding shafts 1013, until the latching blocks 209 are inserted into the corresponding positioning holes 316, and the positioning portions 413 are aligned with the corresponding latching holes 313. The second inserting members 42 are released, thus restoring the resilient members 46 to bias the threaded sleeves 44 and the corresponding first inserting members 41 to move, until the threaded sleeves 44 are stopped by the corresponding first pieces 201, and the positioning portions 413 are inserted into the corresponding latching holes 313. Thus, each end board 30 is perpendicularly latched to the side boards 20 by the mounting apparatuses 40. Therefore, the base 10, the side boards 20, and the end boards 30 cooperatively bound a receiving space for storing goods.

When folding the folding box 100, the second inserting members 42 are pulled away from the corresponding end boards 30, thus elastically deforming the resilient members 46. The threaded sleeves 44 and the first inserting members 41 are moved away from the corresponding end boards 30, until the positioning portions 413 are moved out of the corresponding latching holes 313. The side boards 20 are rotated toward the base 10, until the side boards 20 are supported on the base 10. The end boards 30 are rotated toward the base 10, until the end boards 30 are supported on the side boards 20. Thus, the folding box 100 is folded.

The side boards 20 and the end boards 30 can be rotated toward the base 10, and each end board 30 can be detachably latched to the side boards 20 by the mounting apparatuses 40. Thus, assembly and disassembly of the folding box 100 is convenient.

Even though numerous characteristics and advantages of the embodiments have been set forth in the foregoing description, together with details of the structure and function of the embodiments, the present disclosure is illustrative only, and changes may be made in detail, especially in the matters of shape, size, and arrangement of parts within the principles of the embodiments to the full extent indicated by the broad general meaning of the terms in which the appended claims are expressed.

What is claimed is:

1. A folding box, comprising:

a base comprising a bottom plate, two side plates protruding up from the bottom plate at substantially an edge of two opposite sides of the bottom plate, and two end plates protruding up from the bottom plate at substantially an edge of two opposite ends of the bottom plate;

two side boards rotatably connected to the two side plates of the base;

two end boards rotatably connected to two end plates of the base; and two mounting apparatus mounted to two opposite ends of each side board, each mounting apparatus comprising a first inserting member installable into the corresponding side board;

wherein two or more flanges protrude from two opposite ends of each end board, one or more protrusions protrude out from an inner surface of each flange, each protrusion defines a latching hole aligning with the corresponding first inserting member, and each first inserting member is insertable in the corresponding latching hole, to connect the side boards to the end boards.

2. The folding box of claim 1, further comprising;

a latching block protruding from an end of each side board;

wherein each flange defines a positioning hole, and the latching blocks are detachably latchable to the corresponding positioning holes.

3. The folding box of claim 1, further comprising, a threaded sleeve positioned between the first inserting member and the second inserting member with each end of the side board having a first piece and a second piece extending out therefrom, with the first piece being spaced apart from the second piece; and wherein, the first piece defines a through hole, the second piece defines a fastening hole aligning with the through hole, the first inserting member is slidably insertable into the through hole, each mounting apparatus further comprising a second inserting member slidably insertable into the fastening hole.

4. The folding box of claim 3, wherein each mounting member further comprises a resilient member fitted about the second inserting member, the resilient member being resiliently positionable between the threaded sleeve and the second piece with the resilient member biasing the threaded sleeve against the first piece.

5. The folding box of claim 4, wherein the resilient member is a spring.

6. The folding box of claim 3, wherein, the threaded sleeve is internally threaded, the first inserting member comprises a first threaded pole extendable through the through hole of the first piece to engage the threaded sleeve, the second inserting member comprises a second threaded pole extendable through the fastening hole of the second piece to engage the threaded sleeve and a positioning portion formed at an end of the second threaded pole for positioning the corresponding end board.

7. The folding box of claim 1, wherein, an inner side of each end plate defines a plurality of receiving slots;

a shaft is mounted in each receiving slot substantially parallel to a lengthwise direction of the side plate;

each end board includes a plurality of hook protruding down from a bottom of the end board, the plurality of hooks being recievable into the receiving slots; an the shafts being rotatably connected to the plurality of hooks.

8. A folding box comprising:

a base comprising: a bottom plate, two side plates protruding at an edge of two opposite sides of the bottom plate, and two end plates protruding from the bottom plate at an edge of two opposite ends of the bottom plate;

two side boards rotatably coupled to the two side plates of the base;

two end boards rotatably coupled to the two end plates of the base;

two mounting apparatus mounted to two opposite ends of each of the two side boards, each mounting apparatus including a first inserting member releasably installed onto a corresponding side board;

two flanges protruding from two opposite ends of each of the two end boards;

a protrusion that extends out from an inner surface of each of the two flanges, wherein the protrusion defines a latching hole aligning with a corresponding first inserting member, which is insertable in a corresponding latching hole, thereby connecting the two side boards to the two end boards.

* * * * *